US008844488B2

(12) United States Patent
Kawahara

(10) Patent No.: US 8,844,488 B2
(45) Date of Patent: Sep. 30, 2014

(54) LUBRICATION STRUCTURE FOR ROCKER ARM

(71) Applicant: Otics Corporation, Nishio (JP)

(72) Inventor: Kazunori Kawahara, Nishio (JP)

(73) Assignee: Otics Corporation, Nishio-Shi, Aichi (JP)

( * ) Notice: Subject to any disclaimer, the term of this patent is extended or adjusted under 35 U.S.C. 154(b) by 0 days.

(21) Appl. No.: 13/890,552

(22) Filed: May 9, 2013

(65) Prior Publication Data

US 2013/0306015 A1 Nov. 21, 2013

(30) Foreign Application Priority Data

May 18, 2012 (JP) ..... 2012-114608

(51) Int. Cl.
*F01M 1/06* (2006.01)
*F01L 1/24* (2006.01)
*F01M 9/00* (2006.01)

(52) U.S. Cl.
CPC ..... *F01M 9/00* (2013.01); *F01L 1/2416* (2013.01); *F01L 2810/02* (2013.01)
USPC ..... 123/90.36; 123/90.39; 123/90.43; 74/559; 74/569

(58) Field of Classification Search
USPC ..... 123/90.36, 90.39, 90.43; 74/559, 569
See application file for complete search history.

(56) References Cited

U.S. PATENT DOCUMENTS 7,854,215 B2 * 12/2010 Rozario et al. ..... 123/90.39

FOREIGN PATENT DOCUMENTS

JP 5-248211 A 9/1993

* cited by examiner

*Primary Examiner* — Ching Chang
(74) *Attorney, Agent, or Firm* — Smith, Gambrell & Russell, LLP

(57) ABSTRACT

A lubrication structure for a rocker arm includes a lash adjuster mounted in an accommodating portion located in an end of the rocker arm and a pushrod abutting against a lower end of the lash adjuster. The rocker arm is formed with an arm-inside oil supply passage for supplying lubrication oil to the lash adjuster. The lubrication oil guided into the accommodating portion is further guided through a through guide hole of the accommodating portion to an outer peripheral surface of the accommodating portion. The lubrication oil is further guided from an outer oil supply passage formed downwardly in the outer surface of the accommodating portion to the abutment between the lash adjuster and the pushrod.

6 Claims, 7 Drawing Sheets

LUBRICATION STRUCTURE FOR ROCKER ARM

CROSS-REFERENCE TO RELATED APPLICATIONS

This application is based upon and claims the benefit of priority from the prior Japanese Patent Application No. 2012-114608 filed on May 18, 2012, the entire contents of which are incorporated herein by reference.

BACKGROUND

1. Technical Field

The present invention relates to a lubrication structure for a rocker arm.

2. Related Art

Conventionally known valve gears for internal combustion engines include a rocker arm which is rocked about a cam shaft. One of two ends of the rocker arm is engaged with an upper end of a valve stem of an exhaust or intake valve and the other end of the rocker arm is engaged with a cam, so that the rocker am is rocked by a cam action, whereby the valve is opened and closed. Japanese Patent Application Publication No. JP-A-H05-248211 discloses a valve gear including one of the rocker arms of the above-described type.

In the disclosed valve gear, an adjusting screw is screwed into a valve stem side end of the rocker arm. The adjusting screw has a lower end which is rotatably supported in a receiving member provided at the valve stem side. Furthermore, since the adjusting screw and the receiving member are in a relation that both are rubbed against each other, lubrication oil needs to be supplied to a rotatable support portion between the adjusting screw and the receiving member. For this purpose, in the above-described conventional technique, a lubrication oil hole is axially formed through the adjusting screw so that lubrication oil is supplied through the oil hole to the receiving member.

In the above-described lubrication structure, however, since an oil hole for lubrication has a small diameter, it is not easy to bore a hole with the small diameter so that the hole extends through the adjusting screw. This poses a problem.

SUMMARY

Therefore, an object of the invention is to provide a lubrication structure for a rocker arm, which can easily be manufactured.

The invention provides a lubrication structure for a rocker arm, which supplies lubrication oil to a part of abutment between a lash adjuster mounted on one of two ends of the rocker arm and a pushrod provided below the lash adjuster. In the structure, the rocker arm is rocked about a rocker shaft. The lash adjuster is mounted in an accommodating portion provided in the end of the rocker arm so as to protrude downward. The pushrod is axially movable upward and downward and has a distal end abutting against a lower end of the lash adjuster. The rocker arm is formed with an arm-inside oil supply passage having one of two ends communicating with a shaft oil supply passage provided in the rocker shaft and the other end communicating with an interior of the accommodating portion. The structure further comprises a passage which guides lubrication oil supplied into the accommodating portion, to the abutment between the lash adjuster and the pushrod. The passage is formed by at least one of an inner oil supply passage which is formed in either an outer surface of the lash adjuster or an inner surface of the accommodating portion, so as to be directed downward, and an outer oil supply passage including a through guide hole formed through the accommodating portion and extending from the accommodating portion to an outer surface of the accommodating portion. The outer oil supply passage is directed downward in the outer surface of the accommodating portion.

The lubrication structure according to the invention includes, as a passage guiding the lubrication oil supplied into the accommodating portion to the abutment between the lash adjuster and the pushrod, at least one of the following three routes, namely, (1) a route depending on the inner oil supply passage formed in the outer surface of the lash adjuster, (2) a route depending on the inner oil passage formed in the inner surface of the accommodating portion into which the lash adjuster is assembled, and (3) a route depending on the outer oil supply passage including a through guide hole formed through the accommodating portion and extending from the accommodating portion to an outer surface of the accommodating portion and being directed downward in the outer surface of the accommodating portion.

Any one of the above-described three routes can be formed by a cutting work using a turning tool or casting but not by the conventional boring using a small diameter drill. This can render the forming of the oil supply passages easier.

DETAILED DESCRIPTION

Figure 1:
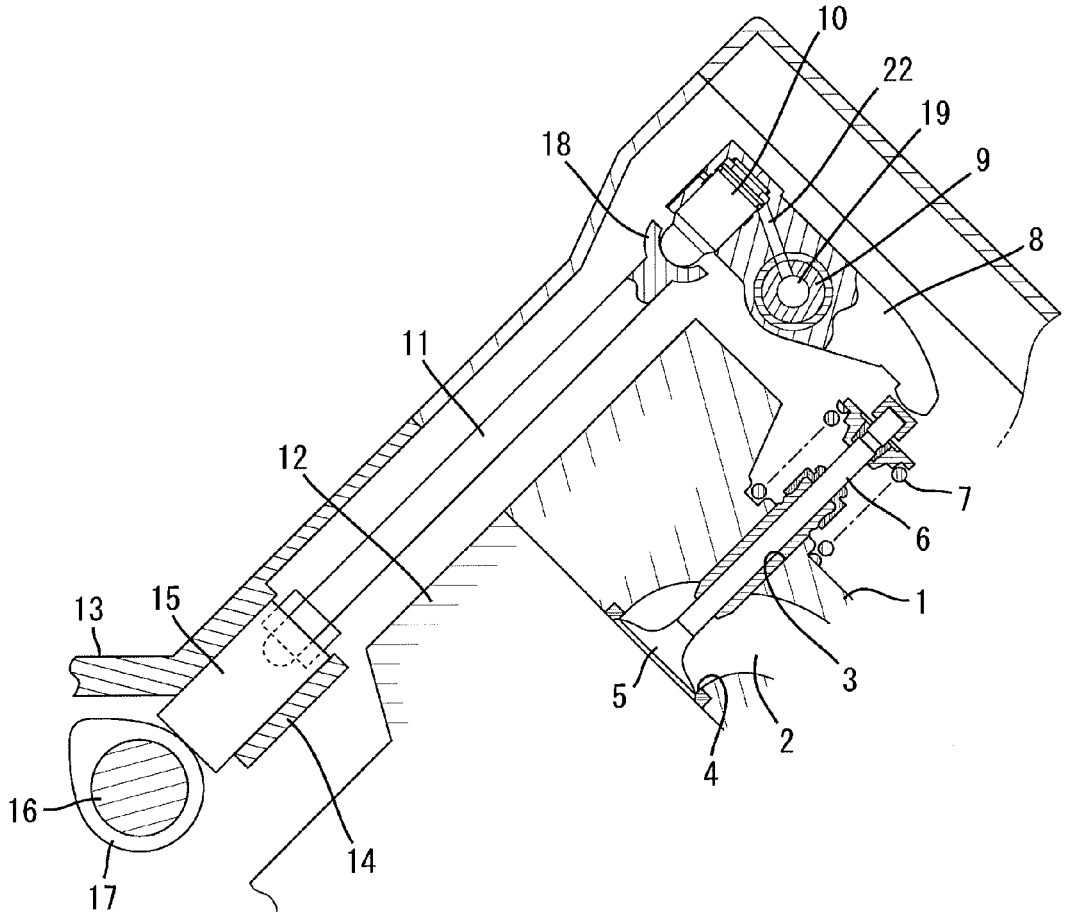
FIG. 1 is a sectional view showing a rocker arm and peripheral structure thereof in a first embodiment.

Several embodiments will be described with reference to the accompanying drawings. Referring to FIGS. 1 to 4, a first embodiment is shown in which the invention is applied to a V-type engine, as an internal combustion engine, having cylinders disposed in two rows set in an angle to each other with a crankshaft running through the point of the V. The V-type engine employs an OHV system as a valve gear system. FIG. 1 shows only one of two rows of cylinders.

An intake port 2 (or an exhaust port) is formed in a cylinder head 1 as shown in FIG. 1. A stem hole 3 is formed through the cylinder head 1 so as to communicate with the intake port 2. In the stem hole 3 is incorporated an intake valve 5 (or an exhaust valve) which opens and closes an intake 4 facing the intake port 2. In the incorporated state, the intake valve 5 is reciprocable between a valve opening position and a valve closing position. The valve 5 includes a valve stem 6 which protrudes upward out of the stem hole 3. A valve spring 7 is attached to the protruding part of the valve stem 6 to bias the valve 5 in a valve closing direction.

A rocker arm 8 is disposed in the cylinder head 1. The rocker arm 8 is supported so as to be rockable about a rocker shaft 9. The rocker arm 8 has two ends and engages at one end side with an upper end of the valve stem 6. The rocker arm 8 also engages at the other end side with an upper end of a pushrod 11 via a lash adjuster 10 which adjusts a valve clearance.

The pushrod 11 is located on a side of the cylinder block 12. On the other hand, a holder plate 13 is mounted in each V bank and is formed with a cylindrical holder 14. A hydraulic tappet 15 is inserted through the cylindrical holder 14 so as to be axially slidable. The hydraulic tappet 15 has an upper end engaging with a lower end of the pushrod 11 and a lower end which is in sliding contact with a peripheral surface of a cam 17 mounted on a cam shaft 16. The pushrod 11 has an upper end formed with a receiving portion 18 for the lash adjuster 10. The receiving portion 18 includes a seating surface which is formed so as to be depressed into a spherical shape, thereby supporting the lash adjuster 10 so that the lash adjuster 10 is slidable.

Figure 2:
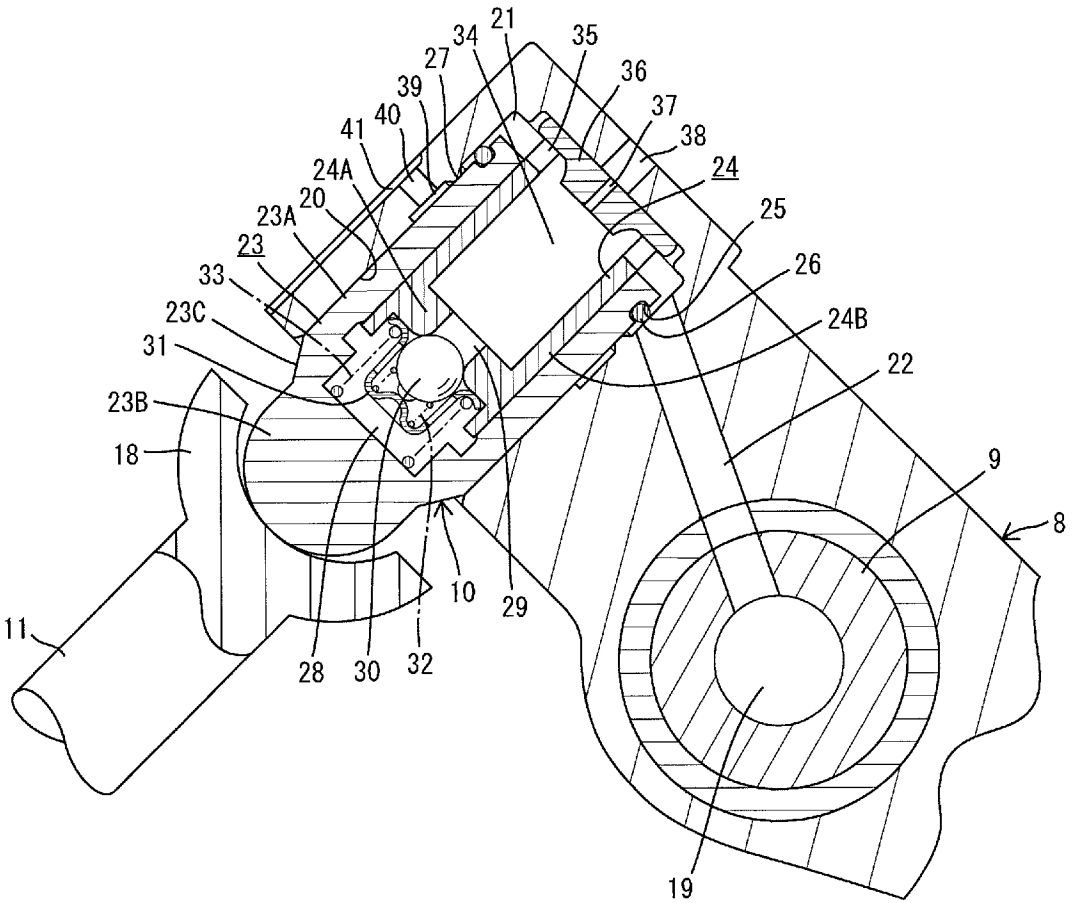
FIG. 2 is an enlarged sectional view showing a lash adjuster and periphery thereof.

The rocker shaft 9 has a shaft oil supply passage 19 which is formed so as to extend axially along a center thereof. The rocker arm 8 is formed with an arm-inside oil supply passage 22 having two ends. The arm-inside oil supply passage 22 communicates at one end side thereof with the shaft oil supply passage 19. The arm-inside oil supply passage 22 also communicates at the other end side thereof with an upper space (a larger diameter portion 21) of an accommodating portion 20 formed in an end of the rocker arm 8 located at the pushrod 11 side, as shown in FIG. 2.

The accommodating portion 20 is formed by recessing the aforesaid other end of the rocker arm 8 so as to be open to the side where the accommodating portion 20 is opposed to the pushrod 11 (downward) and so as to be formed into a cylindrical shape. The lash adjuster 10 is mounted in the accommodating portion 20.

The lash adjuster 10 includes a body 23 and a plunger 24. The body 23 includes a cylindrical main body 23A, a generally semispherical support protrusion 23B provided on a lower end of the body 23 and a tapered transition portion 23C, all of which are formed integrally with one another, as shown in FIG. 2.

When the lash adjuster 10 has been set in the accommodating portion 20, the support protrusion 23B protrudes downward from an underside of the accommodating portion 20 and is supported in the receiving portion 18 of the pushrod 11 so as to be capable of sliding contact with an upper surface of the receiving portion 18. The main body 23A of the body 23 is formed into a bottomed cylindrical shape and is open to the upper end side. The main body 23A has an outer peripheral surface which is slidable on an inner wall surface of the accommodating portion 20 so as to be rotatable about an axis relative to an inner peripheral wall surface of the accommodating portion 20 and axially displaceable. The body 23 has an annular mounting groove 25 located near an upper end of the outer peripheral surface thereof. A retaining ring 26 is fitted in the mounting groove 25. The retaining ring 26 is generally formed into a C-shape such that the retaining ring 26 is elastically deformable, for example, in a direction of reducing a diameter thereof. The diameter of the retaining ring 26 is reduced in the course of coming into sliding contact with the inner wall surface of the accommodating portion 20 from the lower end of the accommodating portion 20 when the lash adjuster 10 is mounted in the accommodating portion 20. The retaining ring 26 is returned to its normal state when further moved to the larger diameter portion 21 formed on the upper end of the inner peripheral surface of the accommodating portion 20. When returned to the normal state, the retaining ring 26 is engaged with a stopper edge 27 (see FIGS. 2 and 3) which is formed on a lower end of the larger diameter portion 21 so as to project, whereupon the body 23 (the lash adjuster 10) is retained in position. The stopper edge 27 has upper and lower surface sides formed into respective tapered surfaces 27A such that the distal edge of the stopper edge 27 is tapered.

A plunger 24 is coaxially inserted into the interior of the body 23. The plunger 24 is axially slidable relative to the body 23 with lubrication oil being interposed therebetween. A high pressure chamber 28 is defined between a bottom of the body 23 and the bottom wall of the plunger 24. A spherical valving element 30 is accommodated in a ball cage 31 and is capable of opening and closing a valve orifice 29. A first spring 32 is also provided in the ball cage 31 to bias the valve orifice 29 upward. A second spring 33 is provided between the ball cage 31 and the bottom of the high pressure chamber 28 outside the ball cage 31 to bias the whole ball cage 31 upward.

The plunger 24 is formed by raising a cylindrical peripheral wall 24B both upward and downward from a peripheral edge of the circular bottom wall 24A, so as to have a bottomed cylindrical shape. The plunger 24 has an interior formed into a low pressure chamber 34. The above-described valve orifice 29 extends centrally through the bottom wall 24A of the plunger 24. The plunger 24 has a plurality of vertical grooves 35 which are formed by partially cutting into an upper end thereof so as to communicate between the larger diameter portion 21 and the low pressure chamber 34. A cap 36 is mounted to the upper end of the plunger 24 and has an air hole 37 extending through a central part thereof. An upper surface of the rocker arm 8 has a through hole 38 that is formed so as to be coaxial with the air hole 37 and so as to have a larger diameter than the air hole 37.

Figure 3:
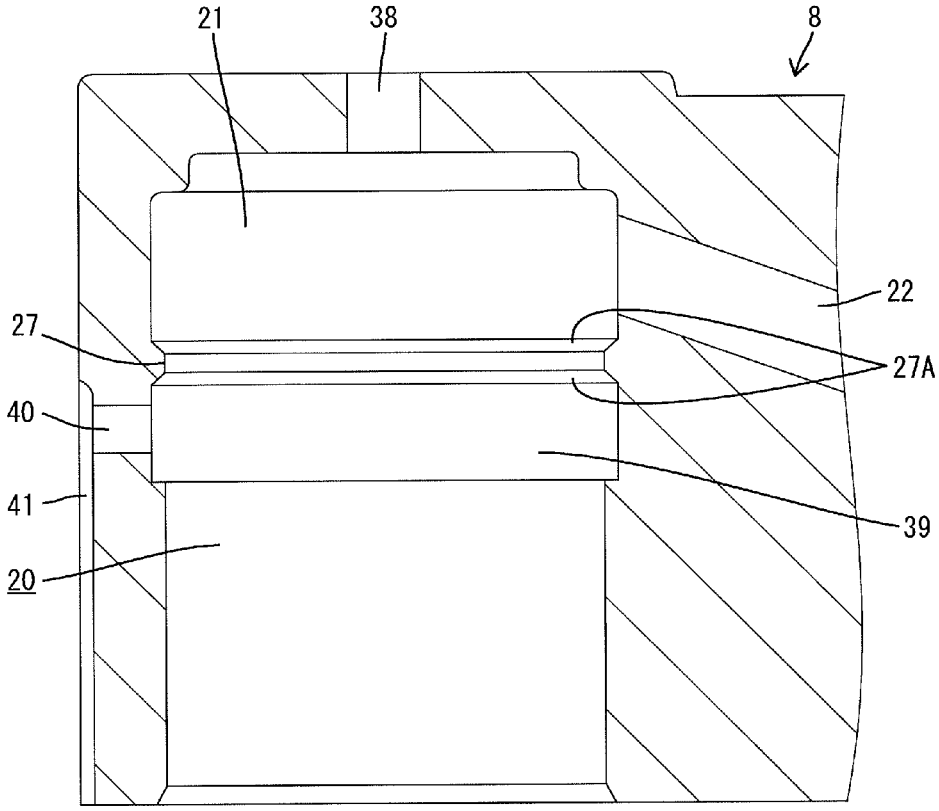
FIG. 3 is a sectional view showing an inner structure of the accommodating portion.
Figure 4:
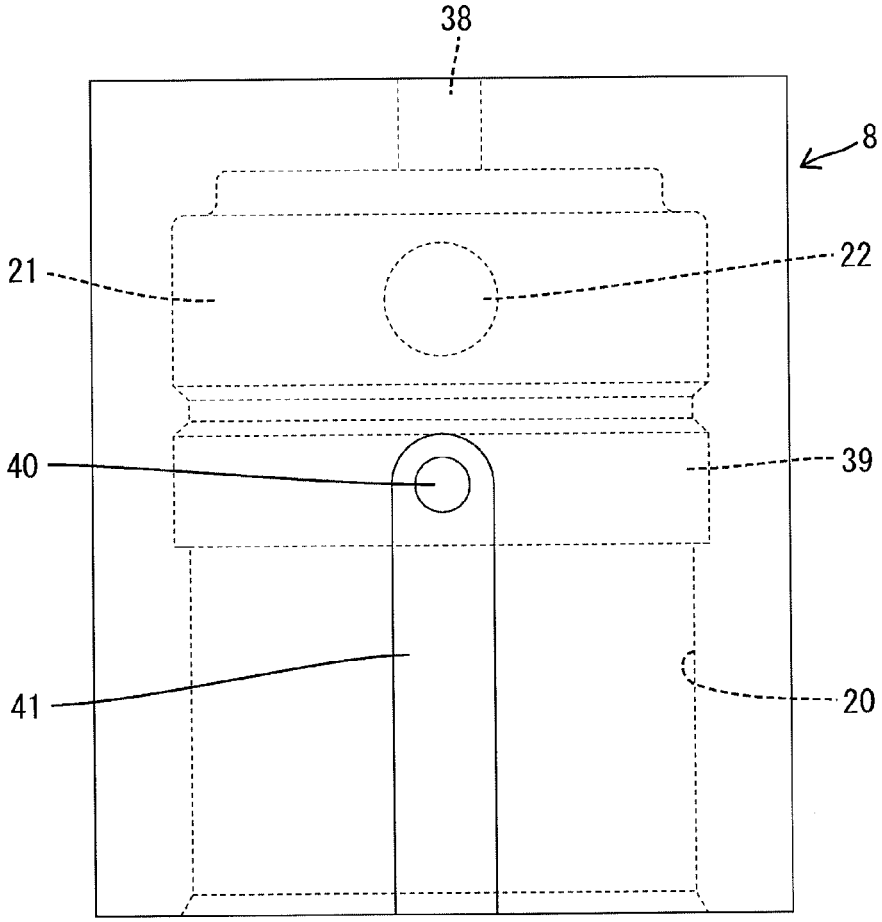
FIG. 4 is a side elevation of the accommodating portion.

The following describes the construction for guiding lubrication oil supplied into the accommodating portion 20 (the larger diameter portion 21), to a sliding contact portion between the receiving portion 18 of the pushrod 11 and the support protrusion 23B of the lash adjuster 10. An annular groove 39 is formed by depressing the whole inner peripheral surface of the accommodating portion 20 located under the stopper edge 27. The annular groove 39 has a guide hole 40 which is open in a bottom thereof and has a smaller diameter than a groove width of the annular groove 39, as shown in FIGS. 2 and 3. The guide hole extends through the accommodating portion 20, thereby reaching the outer surface of the accommodating portion 20. The guide hole 40 is located opposite an end opening of the arm-inside oil supply passage 22 located at the larger diameter portion 21 side and further located slightly below the opening as shown in FIG. 4. On the other hand, an outer oil supply passage 41 including the aforesaid guide hole 40 is provided in the outer surface of the accommodating portion 20 as shown in FIG. 4. The outer oil supply passage 41 is formed by concaving the outer surface of the accommodating portion 20 along the axial direction of the accommodating portion 20, so as to extend vertically in the shape of a groove, reaching the lower end of the rocker arm 8.

Thus, the lubrication oil guided into the larger diameter portion 21 further passes through a small gap defined between the body 23 and the accommodating portion 20, whereby the lubrication oil flows downward with a flow rate thereof being adjusted and is once collected into the annular groove 39. The lubrication oil is subsequently guided through the guide hole 40 into the outer oil supply passage 41. In this case, a predetermined hydraulic pressure is at work on the lubrication oil flowing into the larger diameter portion 21. If the guide hole 40 should be caused to open to the larger diameter portion without the aforementioned flow rate adjustment, the lubrication oil would gush out of the guide hole 40. However, such an inconvenience can be avoided in the embodiment.

More specifically, in order that the lubrication oil may be prevented from gushing out of the guide hole 40, the lubrication oil guided into the larger diameter portion 21 is further guided through the small gap defined between the accommodating portion 20 and the lash adjuster 10 out of the accommodating portion 20, as described above. In this case, without the annular groove 39, an amount of lubrication oil flowing out of the guide hole 40 would be insufficient. In the embodiment, however, the annular groove 39 is provided so that the lubrication oil is once collected in the annular grove 39 and then caused to flow out of the guide hole 40. This can ensure a sufficient amount of lubrication oil flowing down the outer oil supply passage 41.

The lubrication oil flowing through the guide hole 40 out of the accommodating portion 20 flows downward along the outer oil supply passage 41 by the action of gravity. The lubrication oil further flows down the lower end surface of the accommodating portion 20 (the rocker arm 8) to the transition portion 23C of the body 23 and the outer surface of the support protrusion 23B in turn, being supplied along the peripheral surface of the support protrusion 23B to a part of sliding contact portion between the receiving portion 18 and the support protrusion 23B.

The lubrication oil guided into the larger diameter portion 21 takes a second route in which the oil flows from the annular groove 39 downward through the small gap between the body 23 and the accommodating portion 20 to reach the sliding contact portion between the receiving portion 18 and the support protrusion 23B, as well as the above-described first route passing from the annular groove 39 through the guide hole 40. However, an amount of lubrication oil supplied through the second route is smaller as compared with an amount of lubrication oil supplied through the outer oil supply passage 41. An amount of oil supplied only through the second route is insufficient for desirable lubrication. Accordingly, in the first embodiment, the outer oil supply passage 41 entirely assumes the lubrication between the support protrusion 23B and the receiving portion 18.

According to the above-described lubrication structure of the embodiment, the oil passage guiding the lubrication oil to the sliding contact portion between the receiving portion 18 and the support protrusion 23B is realizable by a boring process for forming the guide hole 40 and a cutting process for forming the outer oil supply passage 41 (or forming the passage 41 simultaneously in a process of casting the rocker arm 8). Accordingly, the guide hole 40 can easily be formed since the conventional boring process is not forced to form a long hole with a small diameter. Furthermore, a processing operation can be rendered easier since the processing of the outer oil supply passage 41 is also carried out on the outer surface of the accommodating portion 20.

Figure 5:
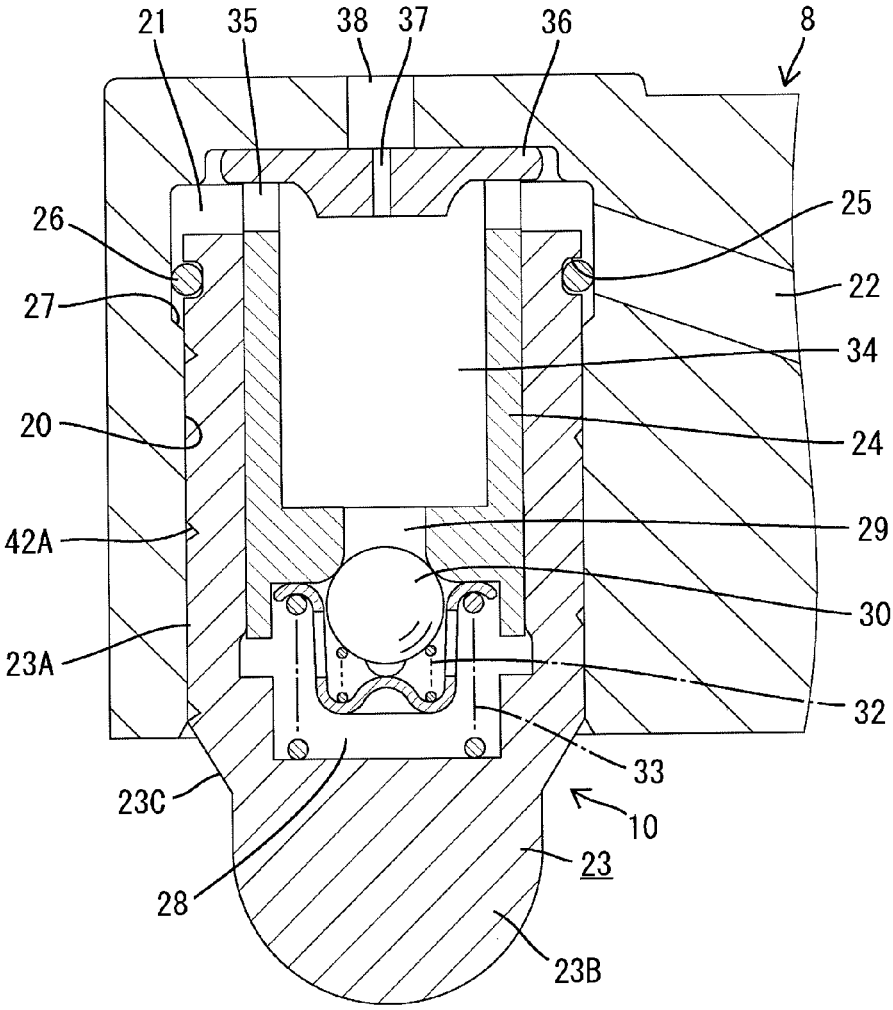
FIG. 5 is an enlarged sectional view showing a part of the lash adjuster assembled into the accommodating portion in a second embodiment.
Figure 6:
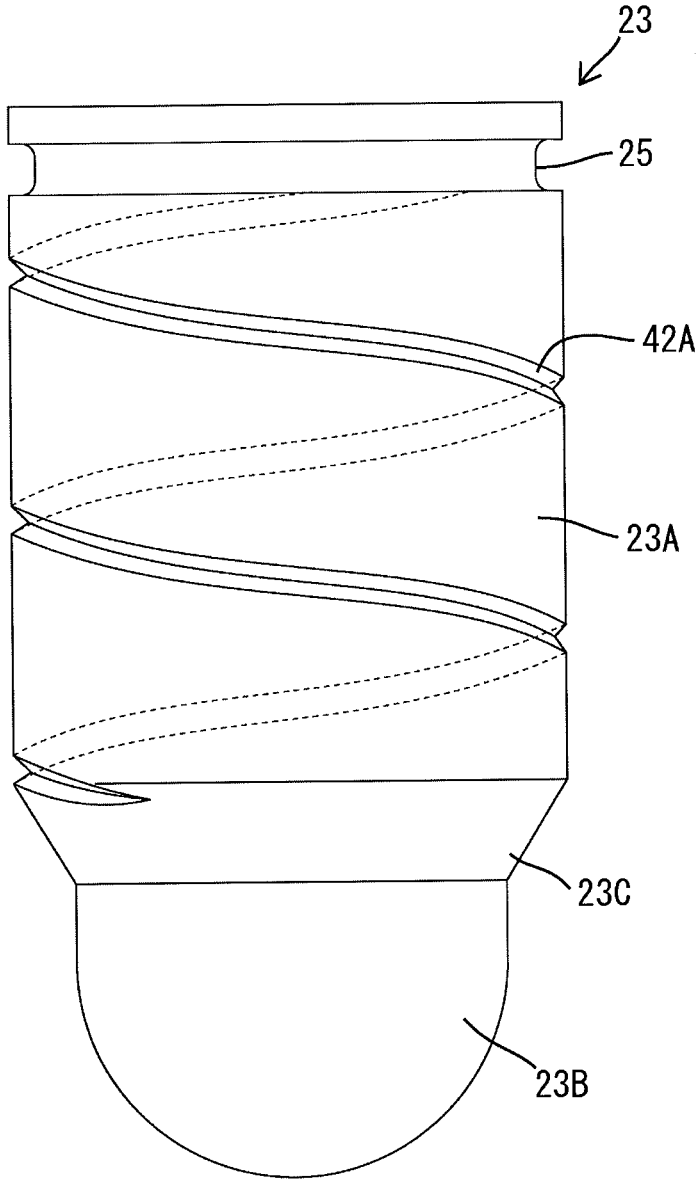
FIG. 6 is a side elevation of a body of the lash adjuster.

FIGS. 5 and 6 illustrate a second embodiment. Supply of lubrication oil is carried out through an inner oil supply passage 42A in the second embodiment, instead of the outer oil supply passage 41. Identical or similar parts in the second embodiment are labeled by the same reference symbols as those in the first embodiment and the description of these identical parts will be eliminated. Only the differences between the first and second embodiments will be described as follows.

Since the outer oil supply passage 41 is eliminated in the second embodiment as described above, the construction related to the outer oil supply passage 41, that is, the guide hole 40 and the annular groove 39 are also eliminated in the embodiment. In the second embodiment, an inner oil supply passage 42A is formed in an outer surface of the body 23 in the lash adjuster 10. The inner oil supply passage 42A is formed by spirally ditching the outer peripheral surface of the body 23 as shown in FIG. 6. In more detail, the inner oil supply passage 42A is formed so as to extend over a length range from the mounting groove 25 to the transition portion 23C. The inner oil supply passage 42A has an upper end facing the interior of the larger diameter portion 21 and a lower end substantially exposed outside the accommodating portion 20. The inner oil supply passage 42A is formed as the spiral groove circling the outer peripheral surface of the body 23 at a plurality of times.

In the second embodiment configured as described above, the lubrication oil guided into the larger diameter portion 21 flows downward along the inner oil supply passage 42A by the action of gravity while circling the outer peripheral surface of the body 23, reaching the outer peripheral surface of the transition portion 23C. Subsequently, the lubrication oil flows along the outer peripheral surface of the support protrusion 23B to the sliding contact portion between the receiving portion 18 and the support protrusion 23B, thereby lubricating the sliding contact portion.

The inner oil supply passage 42A in the second embodiment is formed by cutting the outer peripheral surface of the body 23 of the lash adjuster 10. Accordingly, the forming manner is simpler. Furthermore, since the inner oil supply passage 42A is formed into the spiral shape having an angular range of not less than 360°, the lubrication oil can be supplied peripherally uniformly to the sliding contact portions of the inner peripheral surface of the accommodating portion 20 and the outer peripheral surface of the body 23. Other advantageous effects achieved by the second embodiment are the same as those achieved by the first embodiment.

Figure 7:
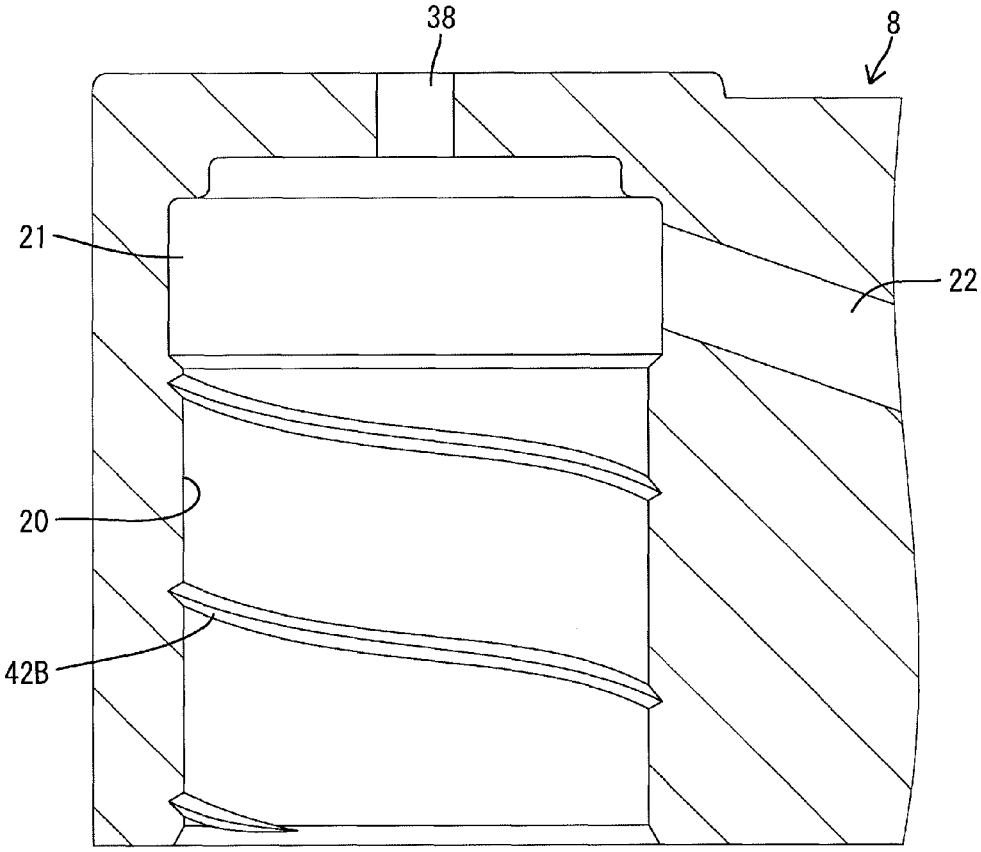
FIG. 7 is an enlarged sectional view showing a part of the lash adjuster assembled into the accommodating portion in a third embodiment.

FIG. 7 illustrates a third embodiment. Although the inner oil supply passage 42A is formed in the outer peripheral surface of the body 23 of the lash adjuster 10 in the second embodiment, an inner oil supply passage 42B is formed in the inner peripheral surface of the accommodating portion 20 in the third embodiment.

In the third embodiment constructed as described above, too, the inner oil supply passage 42B can easily be formed using a turning tool or the like for example, since the accommodating portion 20 has a relatively large diameter. The other construction of the third embodiment is the same as that of the second embodiment and accordingly, the third embodiment can achieve the same advantageous effects as the second embodiment.

The invention should not be limited by the embodiments described above with reference to the drawings. For example, the technical range of the invention also encompasses the following embodiments.

(1) The first embodiment shows an example of ditching the outer peripheral surface of the accommodating portion 20 in the groove shape thereby to obtain the outer oil supply passage 41. Consequently, the lubrication oil can reliably be collected in the groove. However, the lubrication oil may be caused merely to flow down the outer peripheral surface of the accommodating portion 20 without forming into the groove-shape.

(2) Although the lubrication structure includes only the inner oil supply passages 42A and 42B in the second and third embodiments respectively, the lubrication structure may include the outer oil supply passage 41 as well as the inner oil supply passages 42A and 42B.

(3) Although the inner oil supply passage 42A is formed into the spiral groove in the second embodiment, the lubrication structure may include a grid-like combination of axially extending vertical grooves and peripherally extending horizontal grooves, both of which are provided in the outer peripheral surface of the body 23 or in the inner peripheral surface of the accommodating portion 20, instead of the spiral groove.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A lubrication structure for a rocker arm, which supplies lubrication oil to a part of abutment between a lash adjuster mounted on one of two ends of the rocker arm and a pushrod provided below the lash adjuster, wherein the rocker arm is rocked about a rocker shaft;

the lash adjuster is mounted in an accommodating portion provided in the end of the rocker arm so as to protrude downward;

the pushrod is axially movable upward and downward and has a distal end abutting against a lower end of the lash adjuster; and the rocker arm is formed with an arm-inside oil supply passage having one of two ends communicating with a shaft oil supply passage provided in the rocker shaft and the other end communicating with an interior of the accommodating portion, the structure further comprising a passage which guides lubrication oil supplied into the accommodating portion, to the abutment between the lash adjuster and the pushrod, said passage being formed by at least one of an inner oil supply passage which is formed in either an outer surface of the lash adjuster or an inner surface of the accommodating portion, so as to be directed downward, and an outer oil supply passage including a through guide hole formed through the accommodating portion and extending from the accommodating portion to an outer surface of the accommodating portion, said outer oil supply passage being directed downward in the outer surface of the accommodating portion.

2. The structure according to claim 1, wherein the accommodating portion has an inner peripheral surface having an annular groove which is formed by concaving the inner peripheral surface over an entire periphery, so as to be located lower than a location where the arm-inside oil supply passage is open to an interior of the accommodating portion, and the accommodating portion has a guide hole communicating with the annular groove, the guide hole communicating with the outer oil supply passage.

3. The structure according to claim 2, wherein the outer oil supply passage is formed by axially concaving the outer peripheral surface of the accommodating portion and a groove of the outer oil supply passage includes an opening of the guide hole.

4. The structure according to claim 1, wherein the inner oil supply passage is formed into a spiral shape having an angular range of not less than 360°.

5. The structure according to claim 4, wherein the inner oil supply passage is formed in an outer peripheral surface of a body of the lash adjuster.

6. The structure according to claim 4, wherein the inner oil supply passage is formed in an inner peripheral surface of the accommodating portion.

* * * * *